United States Patent [19]

Moore

[11] 3,936,686

[45] Feb. 3, 1976

[54] REFLECTOR LAMP COOLING AND CONTAINING ASSEMBLIES

[76] Inventor: Donald W. Moore, 827 Montline Lane, Los Angeles, Calif. 90024

[22] Filed: May 7, 1973

[21] Appl. No.: 357,823

[52] U.S. Cl. ..... 313/36; 240/41.3; 313/44; 313/46; 313/113

[51] Int. Cl.[2] ..... H01J 61/52; H01K 1/58

[58] Field of Search ..... 313/22, 20, 33, 37, 45, 313/113, 35, 36, 46, 44, 318; 260/46.5 G; 240/103, 41.3

[56] References Cited

UNITED STATES PATENTS

| | | | |
|---|---|---|---|
| 2,190,528 | 2/1940 | Wright | 313/113 |
| 2,594,753 | 4/1952 | Falge | 313/113 |
| 3,248,636 | 4/1966 | Colaiaco | 321/8 C |
| 3,275,874 | 9/1966 | Jennings | 313/113 X |
| 3,319,102 | 5/1967 | Johnson | 313/45 |
| 3,325,665 | 6/1967 | Meijer et al. | 313/113 |
| 3,488,543 | 1/1970 | De Ridder et al. | 313/113 |
| 3,499,859 | 3/1970 | Matherly | 260/46.5 G |
| 3,689,454 | 9/1972 | Smith et al. | 260/46.5 G |
| 3,731,133 | 5/1973 | McRae et al. | 240/103 R |
| 3,885,149 | 5/1975 | Wolfe et al. | 313/318 |

FOREIGN PATENTS OR APPLICATIONS

| | | | |
|---|---|---|---|
| 687,475 | 5/1964 | Canada | 313/44 |

*Primary Examiner*—Siegfried H. Grimm

[57] ABSTRACT

A cooling assembly particularly suitable for use with high brightness light sources requiring compact housing. The assembly comprises an air cooled heat sink and a connecting means being flexible and having a high thermal conductivity coefficient. This device provides an efficient method for cooling filament leads in the seal end of high brightness lamps and the joint between the lamp and reflector, thereby increasing lamp life.

6 Claims, 5 Drawing Figures

REFLECTOR LAMP COOLING AND CONTAINING ASSEMBLIES

BACKGROUND OF THE INVENTION

1. Field of the Invention

This invention relates to improvement of the method of cooling reflector lamps using a high brightness light source.

2. Prior Art

The tungsten-halogen family of incandescent lamps can be used for many light projection purposes. The present invention relates to reflector lamps using the tungsten-halogen incandescent lamps. The bulbs used in these lamps are normally single ended, compact and made of quartz or high silica contend glass. This material is used so that the bulb will withstand resultant high pressures and high temperatures. The quartz bulb also serves to contain a small volume of hot gas about the filament to aid in the performance of the lamp.

The reflector lamp normally uses one ofthe tungsten-halogen incandescent lamps in conjunction with a reflecting surface. This reflecting surface is permanently cemented to the lamp near the seal end of the bulb. Reflectors are normally made of glass in order to be thermally compatable with the lamp and because of the reflective qualities that may be imparted to such glass.

These new tungsten-halogen reflector lamps supply a very compact source of intense light, and have many applications. They are specifically useful in light projection applications such as photographic film, projectors and photographic enlargers.

The benefits provided by this compact source of light have often been greatly reduced because of the intense heat that the lamp produces and the inability to deal with this heat. This intense heat causes several kinds of problems that must be overcome in order to utilize the compact lamp in a reflector type operation. Tungsten halogen lamps of 300 watts have a temperature of 600° centigrade or more, as contrasted with inert gas incandescent lamps which have a substantially lower temperature.

One problem occurs because the two kinds of glass used in the lamp and reflector have different thermal expansion rates. When the joint between the reflector, made from a fused silica glass, and the bulb, made of quartz, is subjected to heat, the two types of glass expand at different rates causing the joint to break or crack. Often the joint between the fused silica reflector and the quartz bulb is of a permanent rigid connection. This inflexibility causes the joint between the bulb and reflector to crack as the reflector expands at a different rate than the quartz bulb. Therefore, in normal operation the maximum temperature must be controlled and limited within a specific range of temperatures, or failure of the bulb or reflector will occur.

Another problem involves the breaking of the seal in the glass between the filament leads of the quartz bulb. The quartz bulb will normally take severe temperature changes, however, the filament leads extend through the end of the bulb where the glass area becomes small in relation to the size of the filament leads. This area of glass when subjected to very high temperatures, will crack due to the difference in thermal coefficients of expansion between the filament leads and the quartz bulb. When the seal of the bulb is broken the filament burns.

Still another problem occurs because the reflector is permanently fastened to the open ends of the quartz bulb. The problem arises because the reflector further reduces cooling by decreasing the area available for dissipating heat and increases the sensitivity of the seal which increase the probability of the seal cracking.

The tungsten-halogen reflector lamps are often used in apparatus that require a very low light leakage since in projectors or photographic enlargers leakage of light impedes the utility of the use. Therefore, baffles often have to be placed to restrict the passage of light from the compact housing surrounding the lamp. These baffles increase the bulk size of the housing rather than decrease it and partially eliminate any benefits derived from the compact light source.

There have been several attempts to solve the problems created by the extreme heat of the tungsten-halogen lamps. One method, and probably the most widely used and suggested by most manufacturers is to direct a blast of air at the seal of the quartz bulb and at the joint between the quartz bulb and the fused silica glass reflector. This approach will solve the problem and will control the extreme heat generated if the air stream is sufficient. However, this solution is not always practical because, in order to direct the air stream a fan with blower ducts must be installed near the housing of the lamp source. Thus, the benefits gained by utilizing the compact high brightness light source is again negated because the size of the apparatus must be increased to be able to contain the blower and the blower ducts.

The forced air can cool the seal, reflector and joint from the rear of the lamp. The open end of the reflector containing the bulb and filament does not need forced air cooling and operates with normal lamp life at a temperature set by radiation cooling only. However, this radiation must still be considered in the overall heating analysis.

Still another problem occurs when a reflector light is used in an apparatus that requires low light leakage since baffles have to be installed to conduct and restrict the light. Here again, the value of the compact size of the intense light source is lost because of the added baffles. Thus, in prior art, in order to use the efficient compact light source an awkward, bulky apparatus must be used in order to house the cooling and shielding equipment that reduces both the light leakage, and the amount of heat created by the tungsten-halogen lamp. This not only results in awkward and bulky housings but also increases expense. In addition, the blower that cools the rear seal is often noisy and reduces the desirability of using the tungsten-halogen lamp.

SUMMARY OF THE INVENTION

The primary component of the cooling system employed in the present invention is a heat sink connected to either a reflector or the lamp itself by means of a flexible adhesive. The flexible adhesive in the present invention is composed of a silicone rubber that maintains its flexibility through a very wide range of temperatures. This flexibility is required to accommodate the different rates of expansion between the bulb, the reflector and the heat sink. The flexibility of the adhesive is important because it allows the bulb, joint, heat sink, and the reflector to expand independently according to their own coefficients of expansion, while maintaining proper alignment within the apparatus.

The adhesive that is used to make a flexible joint is also important because of its thermal qualities. Silicone rubber is used to make the joint flexible because it also has the ability to withstand severe temperature changes. Silicone rubber by itself is not a good conductor, thus, to improve the conductability of the silicone it is filled with metal, ceramic or mineral powder. Thus, the reflector, the lamp and the heat sink are able to remain permanently connected and positioned while the adhesive transmits heat from the bulb and reflector to the heat sink.

The purpose of the heat sink is to dissipate the high temperatures around the seal end of the light bulb by natural convection. This is accomplished by the adhesive material transferring the heat from the quartz bulb and reflector to the heat sink. The heat sink may take many shapes, in fact the housing of the apparatus or even the reflector surface may be used as the heat sink. More commonly a part of the housing or even the interior is used as the heat sink. When this is done a blower may still be required to dissipate the heat energy from the interior of the apparatus, however, the requirements for the size of the blower and the amount of air that must be directed against the heat sink is significantly reduced over prior art techniques for solving the problem of heat dissipation.

In a 300 watt tungsten-halogen incandescent lamp the filament often creates temperatures in excess of 600° centigrade. A maximum temperature of 450° centigrade at the seal end of the bulb is prescribed by most manufacturers. Temperatures in excess of the prescribed temperatures result in severe cracking of the seal end of the bulb which destroys the lamp and temperatures often reach 450° centigrade when forced air cooling of the seal is utilized.

In the present invention when a nominal size heat sink is employed the ambient temperature of the seal of the bulb is reduced to a maximum of 70° centigrade. This invention not only decreases the seal temperature and provides much longer life for the tungsten-halogen lamps, but will allow lamps having much higher wattage to be utilized without altering the present housings which contain the tungsten-halogen reflector lamp. This can be accomplished without increasing the temperature of the heat sink or of the seal in the bulb. For instance in accordance with the present invention a temperature of 210° centigrade at the seal has been recorded when a 1000 watt lamp is employed. This is considerably below the manufactures recommendations of 450° centigrade.

It is important to note that tungsten-halogen lamps, in order to effectively operate, require that a small volume of gas be contained at a high temperature immediately surrounding the filament of the bulb. Any cooling operations must take this into consideration. If the cooling apparatus reduces the temperatures around the bulb the bulb will darken and the effect of using the tungsten-halogen lamp will be lost. The present invention seeks only to cool the seal end of the bulb while allowing the filament to retain the high temperature required for its effective operation.

DETAILED DESCRIPTION OF THE INVENTION

The present invention structure provides for cooling the seal and the joint between a glass reflector and quartz or high silica bulb in a tungsten-halogen reflector lamp. The presently preferred embodiment disclosed herein is particularly useful when employed with the compact high brightness light source of a tungsten-halogen lamp. The present invention will extend the life of these lamps, and in addition will allow lamps with much higher wattage to be used than can be attained in accordance with the present art.

Figure 1:
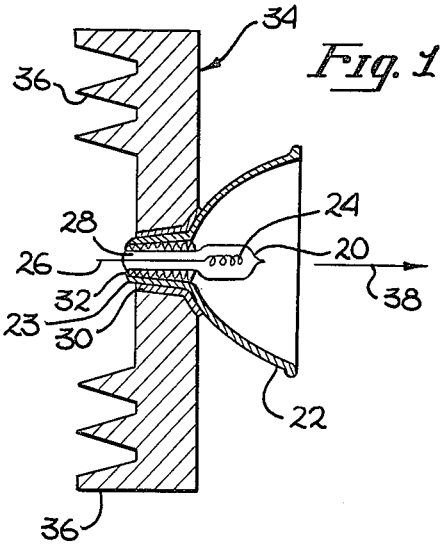
FIG. 1 is a sectional view of a tungsten-halogen lamp and reflector secured to a natural air cooled heat sink.

Referring now to FIG. 1, the presently preferred embodiment is shown. The tungsten-halogen lamp 20 is permanently fastened to a glass reflector 22 with a ceramic cement 32 near the seal end 23 of the bulb 20. The bulb 20 is positioned such that the filament 24 is centrally aligned within the reflector 22 such that the rays 38 can be directed along a specific path.

The critical point when extreme temperatures develop in a tungsten-halogen reflector lamp is at the seal end 23 of the bulb 20. In this region the area of the glass bulb 20 is severely reduced in proportion to the area of the filament 26. It is in this area 23 that high temperatures and thermal differences between the glass bulb 20 and the filament lead 26 cause cracking thereby breaking the seal and allowing contamination to enter and destroy the lamp.

Another critical area lies in the region 23 where the glass reflector 22 is secured to the quartz bulb 20. This joint which is rigid and permanent is a cement 32, which when subjected to severe heat exerts forces on the reflector 22 and the seal 23 leading to cracks because of the differences in thermal expansion coefficients of the glass 22 and the quartz bulb 20. In accordance with the prior art, an air stream would ordinarily be directed at the region 23 to provide cooling by convection. This is often not sufficient and cracks may result at the joint 32 and in the seal end 23 of the quartz bulb 20.

The present invention secures to the reflector a heat sink 34 by means of a silicone adhesive rubber 30. The silicone rubber 30 acts as an adhesive, binding the reflector to the heat sink 34 while conducting heat from the reflector 22 and the bulb 20, and especially from the seal end of the bulb 23, to the heat sink 34. The heat sink 34 then dissipates the energy convectively from the surface area of the heat sink 34. This exposed area often takes the shape of fins 36 as shown in the presently preferred embodiment. (See FIG. 1 for example).

It should be noted that in the presently preferred embodiment the heat sink 34 is shown in a specific shape. In application the heat sink 34 can be made in any shape, in fact the heat sink can either be the housing or portions of the housing within which the tungsten-halogen reflector lamp is used. When the presently preferred embodiment is used a blower is often required to move air across the fin area 36 when it is encased within a housing which restricts the normal flow of air around the fin area 36. If the fin area is exposed and not contained within a small housing it will dissipate the heat energy into the ambient surroundings without the use of a fan or blower.

Figure 5:
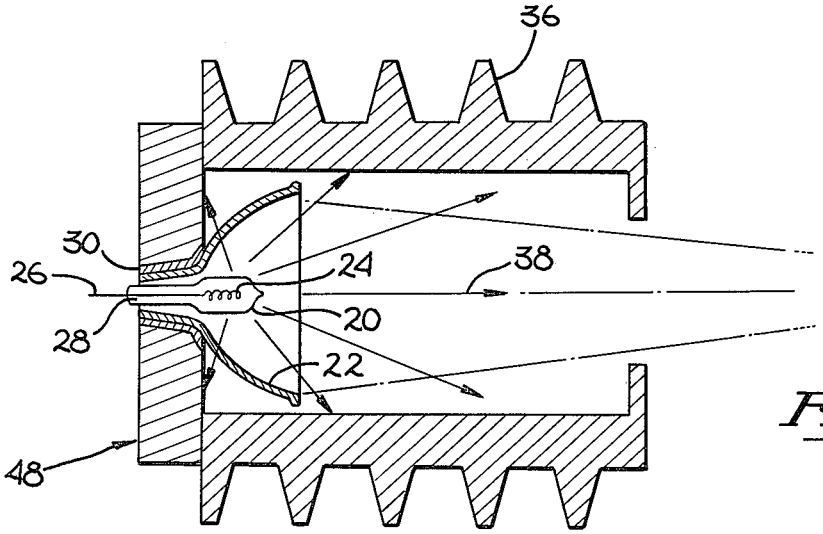
FIG. 5 is a sectional view of a tungsten-halogen lamp wherein the heat sink is also used as a directional limitation and a light leakage limiting device.

FIG. 5 shows another use of the tungsten-halogen lamp and glass reflector 22. In this embodiment the light rays are directed along a specific path 38 and any light leakage is prevented. This type of application is normally required when used in applications such as photographic enlargers. The heat sink 48 in this embodiment is secured to the borosilicate reflector 22 and bulb 20 by the adhesive silicone rubber 30 similar to the method described in the presently preferred embodiment.

In this embodiment however, the heat sink 48 is shaped such that it restricts the direction that the emitted light rays 38 must take. In addition, the heat sink 48 surrounds the reflector lamp preventing any light leakage which is mandatory when used in photographic equipment. The fin area 36 of the heat sink 48 is increased due to the longitudinal sides of the heat sink 48, thereby, lowering the surface temperature of the fins 36. This heat sink besides dissipating the heat near the seal end of the tungsten-halogen bulb 20 dissipates heat given off at the filament end 24 of the bulb 20. This further reduces the temperature within the housing of the apparatus reducing the amount of blower fan required to dissipate the heat energy into the ambient.

Thus, the embodiment shown in FIG. 5 serves two main purposes; first, it prevents any light leakage from around the tungsten-halogen bulb except in a specified direction 38, and second, it provides additional fin area for the heat sink 48 which can be used to more effectively dissipate heat energy from the seal end 23 of the bulb 20.

Figure 4:
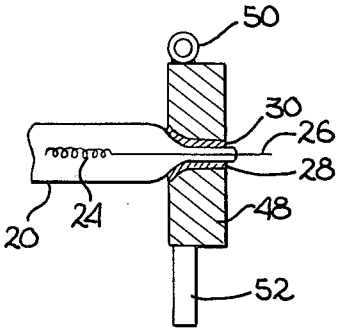
FIG. 4 is a sectional view of a tungsten-halogen reflector lamp using a liquid cooled radiator type heat sink.

FIG. 4 shows an alternative embodiment of the presently preferred embodiment wherein the heat sink 48 instead of being convectively cooled is cooled conductively by fluid. The heat sink size can be reduced to an absolute minimum by using fluid cooling techniques. This technique is very similar to the cooling methods used in a standard automobile, wherein the heat is dissipated into the heat sink and fluid which flows through conduits 50 and 52 from the heat sink to a body of fluid dissipating the energy into the ambient. In this embodiment the tungsten-halogen lamp and glass reflector can be secured to the heat sink similar to the method described in the presently preferred embodiment.

The invention described herein provides a high intensity tungsten-halogen reflector lamp in a compact housing. General Electric developed this high intensity light for use in projectors and photographic enlargers. In order to utilize the tungsten-halogen lamp in this type of operation a reflector mechanism 22 was secured to the tungsten-halogen bulb 20. The reflector 22 is commonly made of glass since it is, easily figured into a complex reflective surface, a reasonable match in thermal characteristics to lamp bulb, may be coated with various reflective materials such as aluminum on dichroic (selectively reflective) films. As has been noted above however, the combination of these two different glasses and method for securing permanent placement of the filament 24 such that precise radiation is achieved has been difficult in the prior art.

Figure 2:
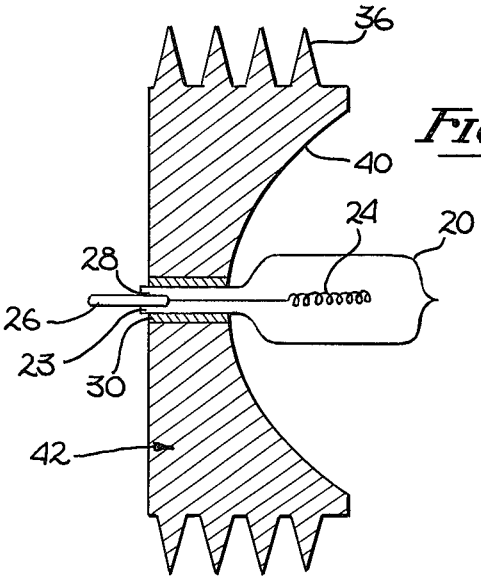
FIG. 2 is a sectional view of a tungsten-halogen lamp wherein the reflector is a natural air cooled heat sink and the bulb is secured directly to the heat sink.
Figure 3:
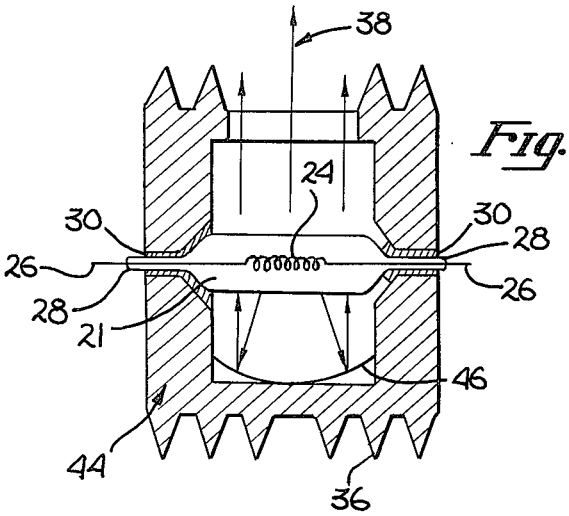
FIG. 3 is a sectional view of a tungsten-halogen lamp utilizing a double ended bulb, wherein the reflector is the heat sink.

The present invention provides a new structure for achieving the directional radiation by eliminating the glass reflector 22. FIG. 2 and FIG. 3 employ the heat sink as the reflector.

In FIG. 2 the alternative embodiment, the heat sink 42 is formed such that it has fins 36 around portions of the perimeter, and a eliptical reflective surface 40 similar to the shape of glass reflector 22 used in the presently preferred embodiment. The heat sink 42 in this embodiment is formed from a metal such as aluminum having a polished surface 40. This polished surface 40 has similar or reflective qualities to a glass reflector 22 used by the prior art manufactures when manufacturing the tungsten-halogen lamp.

In the embodiment shown in FIG. 2 the tungsten-halogen bulb 20 is secured into the preformed reflector heat sink 42 such that the filament 24 is aligned to give proper directional radiational 38 of the rays emitted from the bulb 20. Adhesive silicone rubber 30 is used to secure the seal end of the bulb 23 to the reflective heat sink 42. The adhesive 30 is similar to that used in the presently preferred embodiment shown in FIG. 1 which fastens the heat sink to the glass reflector 22.

By securing the tungsten-halogen bulb 20 to the heat sink 42, two of the major problems involved with the use of reflective lamps are eliminated. First, there is no longer a need to use a cement 32 to fasten the tungsten-halogen bulb 20 to the borosilicate reflector 22, because the glass reflector 22 has been eliminated, and the problem of cracking because of the difference in thermal expansion between the glass reflector 22 and the quartz bulb 20 has been eliminated. Second, the seal end 23 of the filament lead 26 is able to transmit directly the heat generated through the quartz into the heat sink without having to pass through the glass reflector 22.

In addition to the above improvements the use of the reflective surface as a heat sink provides a means of dissipating heat generated around the bulb into the ambient at a much faster rate. This means that when the reflector lamp is placed inside of a compact housing both the heat generated around the filament end of the bulb and the seal end of the bulb 23 can be transmitted directly into the heat sink, which then convectively transmits the heat into the ambient. This advantage will allow utilization of a compact housing when the high intensity light source of a tungsten-halogen lamp is employed.

The last embodiment is shown in FIG. 3. This embodiment employs a reflective surface 46 formed from the metal heat sink very similar to that used in the embodiment shown in FIG. 2. In this embodiment a means of using a double-ended filament bulb is shown. When a double-ended tungsten-halogen bulb 21 is used, both seal ends have to be protected from the severe heat build-up. This is done in much the same manner as was described in the alternative embodiment shown in FIG. 2. This embodiment however, employs a directional radiating surface formed from the heat sink, and a fin area 44 for directing rays emitted from the bulb 21 along the path 38.

I claim:

1. In combination, a. a high brightness incandescent lamp having an operating temperature and a seal end temperature substantially high in comparison to the corresponding temperature of inert gas incandescent lamps, b. means for dissipating heat from the seal end of said incandescent lamp comprising a mass of material having the heat conductivity characteristic thereof at least that of metals and of a quantity sufficient to prevent failure of the seal end region of said lamp, and c. flexible heat conductive adhesive means between said lamp seal end and said heat dissipating means for adhering said lamp and said heat dissipating means and for allowing expansion of said heat dissipating means and said lamp seal end without injury to the latter, said adhesive means comprising a flexible material of low heat conductivity combined with a material of high heat conductivity.

2. The combination of claim 1, wherein the lamp is a reflector lamp and includes a reflector and a bulb, the reflector being permanently fastened to the seal end of the lamp bulb for reflecting the rays of said lamp bulb, said flexible heat conductive adhesive means being between the reflector of the reflector lamp and said heat dissipating means.

3. The apparatus defined in claim 1 wherein said adhesive means is comprised of silicone rubber filled with a heat conducting material.

4. The apparatus as defined in claim 1 wherein said heat dissipating means contains a means of passing liquid through said heat dissipating means such that the heat is absorbed by said liquid and transmitted to the ambient by said liquid after said liquid passes through said heat dissipating means.

5. The apparatus as defined in claim 1 wherein said heat dissipating means shields and directs radiation from said incandescent lamp in a predetermined path.

6. The apparatus as defined in claim 1 wherein said lamp is a tungsten-halogen incandescent lamp.

* * * * *